US006536341B2

(12) United States Patent
Shiki et al.

(10) Patent No.: US 6,536,341 B2
(45) Date of Patent: Mar. 25, 2003

(54) INK FOUNTAIN KEY ADJUSTER USING CORRECTION VALUES BASED ON PRINTING CONDITIONS AND SHEET BLOCK SIZE

(75) Inventors: Masaki Shiki, Fuchu (JP); Hideki Ikeda, Fuchu (JP)

(73) Assignee: Ryobi Ltd., Hiroshima-ken (JP)

( * ) Notice: Subject to any disclaimer, the term of this patent is extended or adjusted under 35 U.S.C. 154(b) by 89 days.

(21) Appl. No.: 09/797,288

(22) Filed: Feb. 28, 2001

(65) Prior Publication Data

US 2001/0018875 A1 Sep. 6, 2001

(30) Foreign Application Priority Data

Mar. 1, 2000 (JP) ..... 2000-056453

(51) Int. Cl.[7] ..... B41F 31/02
(52) U.S. Cl. ..... 101/365; 101/211
(58) Field of Search ..... 101/365, 211

(56) References Cited

U.S. PATENT DOCUMENTS 3,838,777 A * 10/1974 Thornicroft et al. ..... 211/41.17
4,369,706 A * 1/1983 Forster et al. ..... 101/365
5,967,049 A * 10/1999 Seymour et al. ..... 101/365
6,097,503 A * 8/2000 Felleman ..... 358/1.1
6,142,078 A * 11/2000 Lachajewski ..... 101/211
6,318,620 B1 * 11/2001 Anstett et al. ..... 227/147
6,378,429 B1 * 4/2002 Tomita et al. ..... 101/211

* cited by examiner

*Primary Examiner*—Andrew H. Hirshfeld
*Assistant Examiner*—Charles H. Nolan, Jr.
(74) *Attorney, Agent, or Firm*—Perkins Coie LLP

(57) ABSTRACT

An apparatus for controlling ink supply by varying the opening degree of an ink fountain key according to a measured density of a printed matter includes a control means for determining a reference correction value of the opening degree of the ink fountain key according to a density difference between a target density of the printed matter or a reference density and a measured density, and determining a correction value by multiplying the reference correction value by a coefficient having a value of more than 1. The control means controls the ink fountain key according to the correction value of the opening degree of the ink fountain key until the number of sheets printed from the start of the printing exceeds a predetermined number, and controls the ink fountain key according to the reference correction value after the number of sheets printed exceeds the predetermined number.

5 Claims, 2 Drawing Sheets

INK FOUNTAIN KEY ADJUSTER USING CORRECTION VALUES BASED ON PRINTING CONDITIONS AND SHEET BLOCK SIZE

BACKGROUND OF THE INVENTION

1. Field of the Invention

The present invention relates to an ink supply control apparatus in a printing press, which controls an ink fountain key opening degree to assure a predetermined printing density.

2. Discussion of the Background

It has been heretofore known a control apparatus of the type that controls the ink supply in the printing press according to the density of a printed matter measured by a density measuring device so as to set a proper amount of ink to be supplied.

Specifically, a spectrophotometer, which constitutes the density measuring device, first measures a printed color bar, and calculates a density difference in each color with respect to a target printed matter or a reference density value. Signals representative of the calculated density difference are then transmitted to the control apparatus that in turn corrects the opening degree of an ink fountain key of the printing press by an amount or degree corresponding to a correction value for the opening degree, which correction value being determined from the aforesaid density difference, thereby obtaining a proper amount of ink to be supplied in the printing press.

However, according to the control apparatus of the above conventional type, the ink fountain key opening degree is corrected to such an amount or degree which is intended for printing a printed matter with a target density from the start of the printing. Because of this, it takes a relatively long period of time to obtain a key opening degree correction effect.

Specifically, a series of rollers are arranged in plural stages between an ink fountain with ink to be supplied and a plate cylinder on which a printing plate is mounted. According to this arrangement, it is unlikely to supply a proper amount of ink onto the printing plate on the plate cylinder immediately after the correction of the ink fountain key opening degree to a degree corresponding to a target density. This results in a great number of sheets lost before obtaining the printed matter with the target density. The number of the sheets lost depends on the type of ink, the pattern of the printing plate, or the like, but sometimes reaches about 150 to 200. In actual operation, the loss of a relatively large number of sheets poses a serious problem.

The present invention has been conceived to address the above problem. Specifically, it is an object of the present invention to provide an ink supply control apparatus that is capable of efficiently limiting the number of sheets lost before the printed matter reaches a target density.

SUMMARY OF THE INVENTION

According to the present invention, there is provided an apparatus for controlling ink supply by varying the opening degree of an ink fountain key according to a measured density of a printed matter that includes a control means for determining a reference correction value of the opening degree of the ink fountain key according to the density difference between a target density of the printed matter or a reference density and the measured density, and determining a correction value by multiplying the reference correction value by a coefficient having a value of more than 1. The control means controls the ink fountain key according to the correction value of the opening degree of the ink fountain key until the number of sheets printed from the start of the printing exceeds a predetermined number, and controls the ink fountain key according to the reference correction value after the number of sheets printed exceeds said predetermined number.

According to the apparatus having the above arrangement, the opening degree of the ink fountain key is corrected in such a manner as to be larger than the ink fountain key opening degree adapted for the target density when the target density is larger than the measured density during an initial stage from the start of the printing, and to be smaller than the same when the target density is smaller than the measured density. That is, the correction of the ink fountain key opening degree can be performed in such a manner as to enhance the correction effect during the initial stage. As a result, the number of sheets lost before the printed matter reaches the target density can be limited.

The coefficient preferably has a value variable according to a different block of a predetermined number of sheets, and the positive and the negative in value of the reference correction value. Through this coefficient, it is possible to set a proper coefficient according to the type of ink, type of a print sheet, temperature, moisture, type of a printing press, printing speed, percentage of moisture content, or other printing conditions.

DETAILED DESCRIPTION OF THE PREFERRED EMBODIMENT

Figure 1:
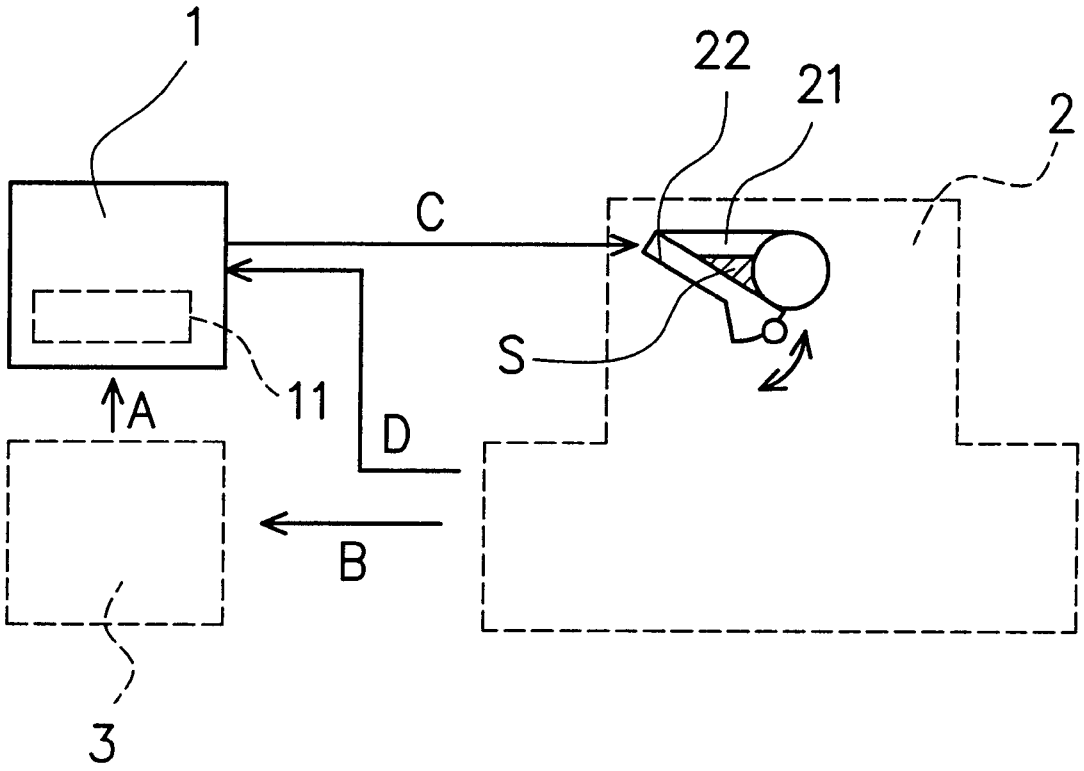
FIG. 1 is a schematic diagram representative of an ink supply control apparatus according to one embodiment of the present invention.

An embodiment of the present invention will be hereinafter described with reference to the drawings attached hereto. FIG. 1 is a schematic diagram representative of the ink supply control apparatus according to one embodiment of the present invention. As illustrated in this Figure, the ink supply control apparatus 1 of this embodiment is connected to a printing press 2 and to a density measuring device 3 adapted for measuring the printed matter, thereby controlling the opening degree of an ink fountain key 22 in the printing press 2 according to the density of the printed matter measured by the density measuring device 3.

The density measuring device 3 is equipped with a spectrophotometer to measure a color bar which runs across the printed matter printed by the printing press 2. The densities of printed colors (cyan, magenta, yellow, black, etc.) each are respectively compared with a density value for each color in a target printed matter or with a reference density value, and then the density differences therebetween are calculated. Then, signals representative of the density differences are transmitted to the control apparatus 1 via a predetermined cable (arrow A in FIG. 1). In this embodiment, the printed matter is manually set on the density measuring device 3 (arrow B in FIG. 1), but the automatic setting is possible by providing a setting mechanism disposed between the printing press 2 and the density measuring device 3.

The control apparatus 1 receives the signals representative of the density differences from the density measuring device 3 and then calculates the correction values of the ink fountain key opening degrees in the respective colors according to the density differences. Specifically, where the density of a color measured by the density measuring device 3 is smaller than the corresponding target value, the control apparatus 1 calculates the correction value of the opening degree enabling the increase in the opening degree of the ink fountain key 22 and hence the amount of ink to be supplied. On the other hand, where the density of a color measured by the density measuring device 3 is larger than the corresponding target value, the control apparatus 1 calculates the correction value of the opening degree enabling the decrease in the opening degree of the ink fountain key 22 and hence the amount of ink to be supplied. The relationship between the density difference and the corresponding correction value of the ink fountain key opening degree (hereinafter referred to a reference correction value) in each color is previously calculated and stored as a correction table in a memory 11 of the control apparatus 1. Accordingly, the control apparatus 1, which has received the signal representative of the density difference for each color from the density measuring device 3, refers to the correction table stored in the memory 11, so that it can calculate the reference correction value of the ink fountain key opening degree.

The control apparatus 1 then multiplies the calculated reference correction value by a predetermined coefficient $\alpha$, and then transmit the signals representative of the calculated result as the correction value of the ink fountain key opening degree to the printing press 2 (arrow C in FIG. 1). The printing press 2 then receives the correction value of the ink fountain key opening degree, and then rotates the ink fountain key 22 via an actuator (not shown) according to this correction value. Whereby, the ink S within the ink fountain key 21 is supplied to the series of rollers disposed at the downstream side of the printing press by such an amount as to enable the printed matter to reach the target density.

It is possible to set the coefficient $\alpha$ to have an arbitrary value of not less than 1 via an input means (not shown) such as a touch panel of the control apparatus 1. The set value, which is resettable, is stored in the memory 11. In this embodiment, the coefficient $\alpha$ has a value of an integer between 1 and 99, which value being set in such a manner as to degrease in stepwise manner per every block of a predetermined number of sheets printed from the start of the printing, and finally converges to 1. The value of the coefficient $\alpha$ is also variable according to the positive and negative in the reference correction value of the ink fountain key opening degree, in which the positive is for the correction enabling the ink fountain key opening degree to increase, and the negative is for the correction enabling the ink fountain key opening degree to decrease. A count signal representative of the number of the printed sheets is output from the printing press 2 (arrow D in FIG. 1), while the control apparatus 1 receives the output count signal to suitably change the coefficient $\alpha$ in the manner as described above.

Figure 2:
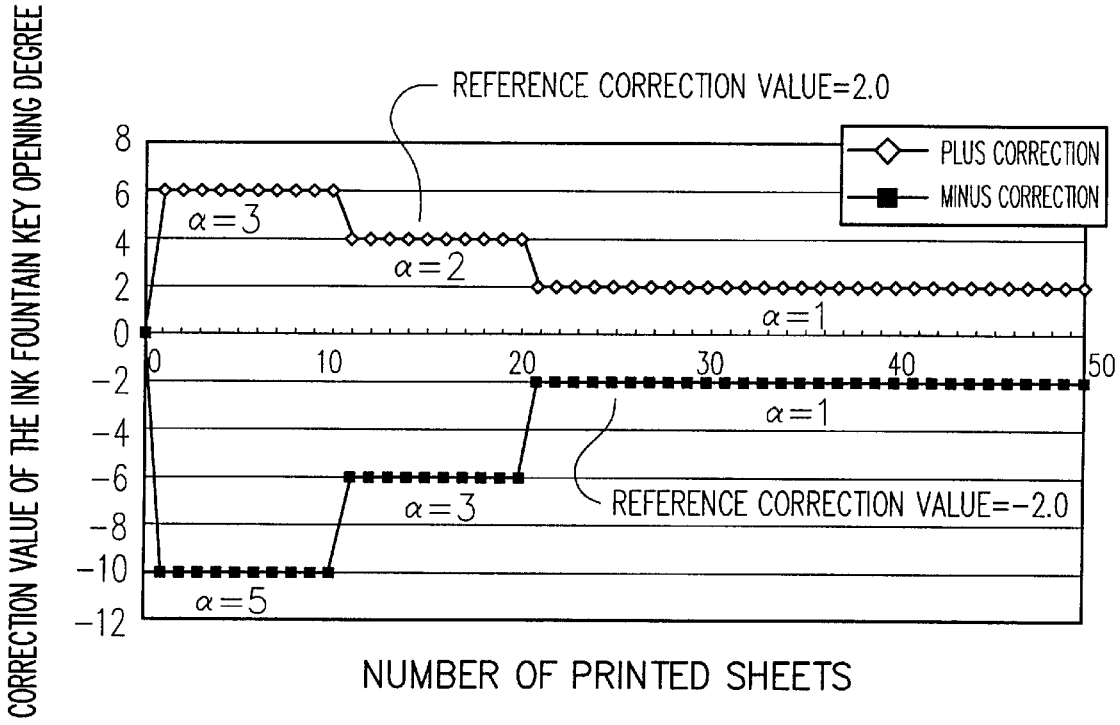
FIG. 2 illustrates an example of the setting variations of the correction value for the ink fountain key opening degree determined by multiplying a reference correction value of the ink fountain key opening degree by a predetermined coefficient.

FIG. 2 illustrates an example of setting variations of the correction value for the ink fountain key opening degree determined by multiplying the reference correction value of the ink fountain key opening degree by a predetermined coefficient $\alpha$.

In the graph present in FIG. 2, the number of sheets printed from the start of the printing or from the start of control is plotted on the horizontal axis and the correction value of the ink fountain key opening degree is plotted on the vertical axis. The stepwisely changing reference correction values of the opening degree are also plotted with both the positive and the negative in value (respectively 2.0 and −2.0 (dimensionless number)). According to the example in FIG. 2, when the reference correction value is equal to 2.0 (hereinafter referred to a plus correction), the coefficient $\alpha$ has a value set to an integer of 3 for the printing of 1 to 10 sheets, and stepwisely reduced to integers of 2 and 1 respectively for the printing of 11 to 20 sheets, and 21 and more sheets. On the contrary, when the reference correction amount is equal to −2.0 (hereinafter referred to a minus correction), the coefficient $\alpha$ has a value set to an integer of 5 for the printing of 1 to 10 sheets, and stepwisely reduced to integers of 3 and 1 respectively for the printing of 11 to 20 sheets, and 21 and more sheets. As a result, the number of sheets lost before the printed matter reaches the target density can be limited to about 50 sheets. In consideration of the difference in response after the correction of the ink fountain key opening degree, the coefficient $\alpha$ for the minus correction has a value set smaller than the value for the plus correction.

The coefficient $\alpha$, which is an integer in this embodiment, may be without limitation thereto an arbitrary value including a decimal fraction to enable the fine adjustment. In order to reduce the outputting of signal (one outputting per every ten sheets is sufficient in the example of FIG. 2), and in view of the fact that a specific effect can be obtained even through the coefficient $\alpha$ having a value decreasing in stepwise manner when considering the viscosity of ink, the coefficient $\alpha$ preferably has a value decreasing in stepwise manner per every predetermined number of sheets. However, the present invention is not necessarily limited to this stepwise manner. Rather, the coefficient $\alpha$ can have a value steplessly changeable for every one sheet. It is also possible to prepare the coefficient $\alpha$ of different values for different types of ink, different types of paper for printing, or the like, store it as a table in the memory 11, and read out a proper value from the table according to a specific type of ink, paper or the like. In this embodiment, the same density correction is commonly performed for the respective colors (cyan, magenta, yellow, block, etc.), and therefore the common value is employed for the coefficient $\alpha$ for the respective colors. However, it is possible to employ the coefficient $\alpha$ of different values for the respective colors.

As described above, the ink supply control apparatus of the present invention is designed to regulate, until the number of printed sheets exceeds a predetermined number, the ink fountain key according to the correction value of the ink fountain key opening degree determined by multiplying the reference correction value by the coefficient having a value of more than 1, in which the reference correction value of the ink fountain key opening degree is determined based upon the density difference between the target density of the printed matter or the reference density and the measured density. After the number of the printed sheets exceeds the predetermined number, the ink fountain key is regulated according to the aforesaid reference correction value of the ink fountain key opening degree in place of the correction value. Therefore, in the initial stage of the printing, the ink fountain key opening degree is corrected in such a manner as to be larger than the opening degree adapted for the target density when the target density is larger than the measured density, and to be smaller than the same when the object density is smaller than the measured density. That is, the correction of the ink fountain key opening degree is performed in such a manner as to enhance the correction effect in the initial stage. As a result, the ink supply control apparatus of the present invention produces an excellent effect that the number of sheets lost before the printed matter reaches the object density can be limited.

Particularly for the coefficient having a value, which is variable according to a different block of a predetermined number of sheets, and the positive and the negative in the reference correction value of the ink fountain key opening degree, it is possible to have the coefficient having a value properly set according to the type of ink, type of a print sheet, temperature, moisture, type of a printing press, printing speed, percentage of moisture content, or other printing conditions.

This specification is by no means intended to restrict the present invention to the preferred embodiments set forth therein. Various modifications to the ink supply control apparatus, as described herein, may be made by those skilled in the art without departing from the spirit and scope of the present invention as defined in the appended claims.

What is claimed is:

1. An apparatus for controlling ink supply by varying the opening degree of an ink fountain key according to a measured density of a printed matter comprising:

a control means for determining a reference correction value of the opening degree of said ink fountain key according to the density difference between a target density of the printed matter or a reference density and the measured density, and determining a correction value by multiplying said reference correction value by a coefficient having more than 1, wherein said control means control the ink fountain key according to said correction value of the opening degree of said ink fountain key with said coefficient stepwisely reduced per every first predetermined number of sheets until the number of sheets printed from the start of the printing exceeds a second predetermined number, and controls the ink fountain key according said reference correction value after the number of sheets printed exceeds said second predetermined number.

2. An apparatus for controlling ink supply according to claim 1, wherein said coefficient has a value variable according positive and negative values of said reference correction value.

3. An apparatus for controlling an ink fountain key comprising:

an ink density measuring device;

a controller coupled to said ink density measuring device, wherein said controller is operatively coupled to said ink fountain key.

wherein said controller includes an executable program stored on a computer readable medium which generates correction values for an opening degree on said ink fountain key, wherein said executable program compares a target density value to a value supplied by said ink density measuring device and generates a correction value as a result, wherein said executable program medium multiplies said correction value by a predetermined coefficient to create a signal for controlling said opening degree, said coefficient being reduced by a step amount per every first number of sheets, until the number of sheets printed from the start of the printing exceeds a second predetermined number.

4. The ink controlling apparatus as claimed in claim 3, wherein said ink density measuring device is a spectrophotometer.

5. The ink controlling apparatus as claimed in claim 3, wherein said predetermined coefficient is not less than 1 and converges to 1 by said step amounts per said first number of sheets, if greater than 1, wherein said coefficient can include numerical values factored into it from one or more of the following printing conditions: respective colors, type of ink, type of paper, temperature, moisture, type of printing press, type of print sheet, printing speed.

* * * * *